US009321147B2

(12) United States Patent
Cho et al.

(10) Patent No.: US 9,321,147 B2
(45) Date of Patent: Apr. 26, 2016

(54) DESCALING APPARATUS

(75) Inventors: Soo-Hyoun Cho, Gwangyang-si (KR); Tae-Chul Kim, Gwangyang-si (KR); Young-Sool Jin, Gwangyang-si (KR)

(73) Assignee: POSCO, Pohang-si (KR)

( * ) Notice: Subject to any disclaimer, the term of this patent is extended or adjusted under 35 U.S.C. 154(b) by 210 days.

(21) Appl. No.: 13/701,530

(22) PCT Filed: Jun. 8, 2011

(86) PCT No.: PCT/KR2011/004201
§ 371 (c)(1),
(2), (4) Date: Dec. 3, 2012

(87) PCT Pub. No.: WO2011/155768
PCT Pub. Date: Dec. 15, 2011

(65) Prior Publication Data

US 2013/0084785 A1 Apr. 4, 2013

(30) Foreign Application Priority Data

Jun. 9, 2010 (KR) ..... 10-2010-0054438

(51) Int. Cl.

| | |
|---|---|
| ***B24C 5/04*** | (2006.01) |
| ***B24C 3/32*** | (2006.01) |
| ***B21B 45/06*** | (2006.01) |
| ***B24C 1/08*** | (2006.01) |
| ***B24C 3/08*** | (2006.01) |
| ***B24C 7/00*** | (2006.01) |
| *B21B 45/08* | (2006.01) |

(52) U.S. Cl.

CPC . *B24C 3/32* (2013.01); *B21B 45/06* (2013.01); *B24C 1/086* (2013.01); *B24C 3/08* (2013.01); *B24C 7/0076* (2013.01); *B24C 7/0084* (2013.01); *B21B 45/08* (2013.01)

(58) Field of Classification Search

CPC ..... B24C 1/086; B24C 3/08; B24C 3/12; B24C 5/04; B24C 5/02; B24C 7/0007
USPC ..... 451/75, 83, 89, 102; 366/339
See application file for complete search history.

(56) References Cited

U.S. PATENT DOCUMENTS 3,427,763 A * 2/1969 Maasberg Wolfgang ..... B24C 1/086 451/40
4,666,083 A * 5/1987 Yie ..... B05B 7/1486 239/403

(Continued)

FOREIGN PATENT DOCUMENTS

CN 1765582 A 5/2006
CN 101306410 A 11/2008

(Continued)

*Primary Examiner* — Joseph J Hail
*Assistant Examiner* — Jon Taylor
(74) *Attorney, Agent, or Firm* — The Webb Law Firm

(57) ABSTRACT

Provided is a descaling device for effectively removing scale formed on a surface of a hot-rolled steel strip (steel sheet). The descaling device, for example, may be configured to include: a device housing disposed in a feed path of a hot-rolled steel strip, a high-pressure fluid supply unit provided to supply a high-pressure fluid to the device housing, an abrasive input unit provided to introduce an abrasive to the device housing, and an abrasive slurry spraying unit provided in the device housing to spray an abrasive slurry of the high-pressure fluid and the abrasive mixed inside the device housing on the steel strip.

10 Claims, 9 Drawing Sheets

(56) References Cited

U.S. PATENT DOCUMENTS

| | | | | |
|---|---|---|---|---|
| 5,035,090 | A * | 7/1991 | Szucs | B05B 7/10 239/403 |
| 5,174,651 | A * | 12/1992 | Gaddis | 366/332 |
| 5,370,069 | A * | 12/1994 | Monroe | A01C 21/00 111/118 |
| 5,921,846 | A * | 7/1999 | Katz | B24C 5/04 451/102 |
| 6,390,899 | B1 * | 5/2002 | Loubeyre | B24C 7/0084 451/102 |
| 2008/0290197 | A1 | 11/2008 | Fecht et al. | |
| 2010/0075579 | A1 * | 3/2010 | Knisel | B24C 1/003 451/99 |

FOREIGN PATENT DOCUMENTS

| | | | |
|---|---|---|---|
| CN | 101641185 | A | 2/2010 |
| JP | 59-042850 | U | 3/1984 |
| JP | 01-166098 | U | 11/1989 |
| JP | 03-111173 | A | 5/1991 |
| JP | 04115869 | A | 4/1992 |
| JP | 04-086166 | U | 7/1992 |
| JP | 06-226634 | A | 8/1994 |
| JP | 07-227763 | A | 8/1995 |
| JP | 09-225833 | A | 9/1997 |
| JP | 09-248766 | A | 9/1997 |
| JP | 10-024318 | A | 1/1998 |
| JP | 10058325 | A | 3/1998 |
| KR | 100302396 | B1 | 7/2001 |

* cited by examiner

FIG. 9

| Comparative Example 1 | Comparative Example 2 | Comparative Example 3 | Present invention |
|---|---|---|---|
| 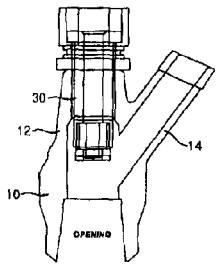  | 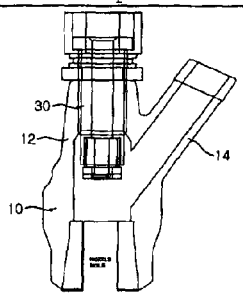  | 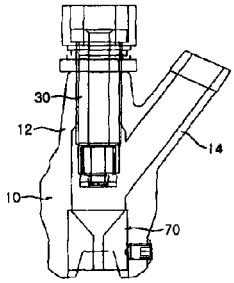  | 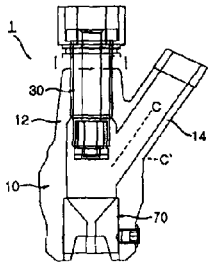  |
| Defective treatment of scale | Defective treatment of scale | Incomplete treatment of scale | Good treatment of scale |
| In the case that the lower end of the device housing is formed as a simple opening, the formation of a negative pressure space is insufficient, and thus, the input of the abrasive into the device may not be smoothly performed | In the case that a simple nozzle hole is formed in the device housing, normal descaling may be difficult due to the non-uniform suction of the abrasive | The spacing between the high-pressure water supply unit 30 and the abrasive slurry spraying unit 70 is excessively narrow and thus, the abrasive and the high-pressure water are sprayed before they are sufficiently and uniformly mixed into an abrasive slurry | Realizing the best descaling due to an appropriate spacing between the high-pressure water supply unit and the abrasive slurry spraying unit |

DESCALING APPARATUS

TECHNICAL FIELD

The present invention relates to a descaling device for removing scale or other residual foreign objects formed on a surface of a hot-rolled steel strip (steel sheet), and, more particularly, to an environmentally-friendly descaling device for realizing the removal of scale or other residual foreign objects on the surface of a hot-rolled steel strip (steel sheet) through an environmentally-friendly physical (mechanical) method excluding a typical chemical treatment and, in addition, for highly efficiently removing scale by the simplification of a device structure and a descaling process as well as appropriate maintenance and adjustment of average surface roughness of the steel strip after descaling.

BACKGROUND ART

A scald layer about 5 μm to 15 μm thick is commonly formed on a surface of a hot-rolled steel sheet (steel strip), e.g., a hot-rolled carbon steel sheet, a high strength steel sheet, a silicon added steel sheet for an electric motor, or a stainless steel sheet.

For example, FIG. 1 illustrates a well known facility for removing the scale formed on the surface of a hot-rolled steel sheet.

That is, as illustrated in FIG. 1, the generally known typical pickling facility for descaling removes scale while a steel sheet stepwisely passes through a pickling tank 240 and a washing tank 250, after cracks are formed in the scale by using a scale breaker 230.

The pickling tank 240 is typically composed of four unit pickling tanks 242, 244, 246, and 248, and the picking tank mainly uses a high-temperature strong acid, such as hydrochloric acid or sulfuric acid, to chemically remove scale from the surface of the hot-rolled steel sheet passing therethrough.

At this time, undescribed reference numerals in FIGS. 1, 210, 220, and 260 respectively denote a pay-off reel, a welder, and a tension reel, and, although not specifically illustrated, the washing tank 250 may be divided as brushing and rinsing operations.

However, with respect to the foregoing typical scale treatment method illustrated in FIG. 1, there are various limitations, such as an increase in the length of the facility due to the use of a plurality of pickling tanks and washing tanks, obstruction of working environments due to the generation of acid vapors, the generation of environmentally hazardous waste products due to waste acid treatment, an increase in required supplementary facilities due to acid recovery and the need for acid resistant equipment, differences in descaling performances according to steels, and the occurrence of quality failures in the case of steel sheets remaining in acid solution tanks and washing tanks in the case that the production line stops.

For example, although schematically illustrated in FIG. 1, since the lengths of the actual pickling tank 240 and the washing tank 250 are about 100 meters in a method of removing scale through the foregoing typical pickling treatment, the surface qualities of hot-rolled steel sheets remaining in the pickling tank and the washing tank may be deteriorated due to an excessive acid treatment in the case that the production line stops.

Meanwhile, as an another method of removing scale for addressing the limitations of the typical method of removing scale by the medium of chemical pickling by using the foregoing acid solution illustrated in FIG. 1, a technique of removing scale from a surface of a steel sheet by using a physical method has been developed, in which metal shot balls or grit particles are in contact with the surface of the steel sheet or a slurry having metal shot balls or grit particles mixed with water is in contact with the surface of the steel sheet by using a centrifugal force.

However, the physical descaling method using shot balls or grit particles is performed in parallel with a known pickling process, in which the physical descaling method using shot balls or grit particles is mainly used as a pretreatment process for pickling to increase pickling efficiency in special steels, such as stainless steel sheets or electrical steel sheets, steels traditionally difficult to be pickled. For example, the physical descaling process using shot balls or grit particles is not applied to general carbon steels.

Meanwhile, another physical method for removing scale has been developed, in which a slurry having stainless steel (STS) beads mixed with water, instead of typical shot balls or grit particles, is in contact with a surface of a steel sheet through centrifugal force.

However, with respect to descaling methods, in which metal shot balls or grit particles are in contact with the surface of the steel sheet or a slurry having stainless steel beads mixed with water is in contact with the surface of the steel sheet through centrifugal force, since an average surface roughness (Ra) of the steel sheet after descaling is in a range of 2.3 μm to 3.5 μm due to a phenomenon of embedding in the steel sheet, the surface roughness of the descaled steel sheet may be entirely non-uniform. In addition, a unit price of the stainless steel beads may be high.

Meanwhile, other descaling techniques, such as a method of removing scale through the injection of high-pressure water or a method of injecting ice particles, have been developed, but descaling efficiencies thereof may be insignificant, and the commercialization thereof may be difficult.

SUMMARY OF THE INVENTION

An aspect of the present invention provides a descaling device providing a highly efficient descaling environment suitable for high-speed strip-passing as well as being more environmentally friendly by uniformizing average surface roughness of a steel strip (steel sheet) after descaling, while realizing a physical (mechanical) method of removing scale or other foreign objects without a typical chemical treatment.

Another aspect of the present invention provides a descaling device able to simplify processing or a processing facility by effective descaling as well as simplification of a device structure being achieved by the introduction of an abrasive to the device through the formation of negative pressure.

According to an aspect of the present invention, there is provided a descaling device including: a device housing disposed in a feed path of a hot-rolled steel strip; a high-pressure fluid supply unit provided to supply a high-pressure fluid to the device housing; an abrasive input unit provided to introduce an abrasive into the device housing; and an abrasive slurry spraying unit provided in the device housing to spray an abrasive slurry having the high-pressure fluid and the abrasive mixed inside the device housing onto the steel strip.

The high-pressure fluid supply unit provided in the device housing may provide the high-pressure fluid by injecting the high-pressure fluid inside the device housing, and may be configured to smoothly introduce the abrasive into the inside of the device housing by using injection pressure of the high-pressure fluid.

The abrasive may have a specific gravity lower than that of metal.

At this time, the abrasive may be formed of one of silicon oxide, silicon carbide, aluminum oxide, glass, or a ceramic having a particle diameter ranging from 10 μm to 400 μm.

The device housing may include a first connecting portion connected to the high-pressure fluid supply unit; a second connecting portion connected to the abrasive input unit; and a spraying unit assembly portion having the abrasive slurry spraying unit assembled therein.

The high-pressure fluid supply unit may include a high-pressure fluid inlet provided inside the first connecting portion included in the device housing and having the high-pressure fluid supplied thereto; and a high-pressure fluid nozzle provided to the high-pressure fluid inlet and having a nozzle hole formed therein to inject the high-pressure fluid into the inside of the device housing.

At this time, a position of a horizontal line at a lower end of the high-pressure fluid nozzle may be adjusted to meet with a center point of an outlet of the inclined second connecting portion included in the device housing.

In addition, the high-pressure fluid may be formed of high-pressure water injected through the high-pressure fluid nozzle in a pressure range of 100 bar to 500 bar, and spacing between the abrasive slurry spraying unit included in the device housing and the steel strip may be in a range of 100 mm to 350 mm.

The abrasive input unit may include an abrasive input hose connected to the second connecting portion included in the device housing, and a negative pressure space allowing the abrasive to be introduced into the device housing through suction by the medium of injection pressure of the high-pressure fluid may be formed inside the device housing.

The abrasive slurry spraying unit may include a spraying unit body provided in the spraying unit assembly portion included in the device housing; a depressed portion formed in an upper portion of the spraying unit body; and an abrasive slurry spray opening formed by penetrating through the body from the depressed portion.

The depressed portion in the spraying unit body is concavely formed to have a conical shape from an upper end of the spraying unit body to an inner side thereof, and the spray opening is formed as a slit formed by integrally penetrating from a center of the conical depression portion to a lower end of the body.

At this time, a cut portion having a predetermined angle through the spray opening may be further formed at both sides of the lower end of the spraying unit body.

The descaling device may further include a mixing unit provided in the device housing to allow the high-pressure fluid and the abrasive to be smoothly mixed therein.

The mixing unit may be provided as a fixed-type mixing unit formed of one of one or more grid units provided between the high-pressure fluid supply unit and the abrasive slurry spraying unit and one or more conical coils provided between the grid units or independently provided in the device housing, or provided as a combination thereof.

The mixing unit may be provided as a rotary type mixing unit included in a rotational axis provided between the high-pressure fluid supply unit and the spraying unit in the device housing and may include rotors or rotation bars rotated by collision of the high-pressure fluid.

According to a descaling device of the present invention, since scale of a hot-rolled strip (steel sheet) may be continuously removed and, in particular, descaling efficiency may be secured even in the case that a high-speed treatment as well as the size of facility being reducible, cost reduction may be possible as well as productivity being improved.

In particular, a more environmentally-friendly operations may be possible in a facility by removing environmental hazards due to the generation of acid vapors, acid recovery, and a waste acid treatment generated during a typical pickling treatment.

Also, since the surface quality of the steel sheet may be ultimately improved by removing non-uniformity of the surface roughness according to the use of typical metal shot balls, grit particles, or beads, an improvement of quality may be possible in a subsequent process, such as plating of the steel sheet.

In particular, the present invention is suitable for removing scale from the surface of a hot-rolled steel strip, such as hot-rolled low carbon steel sheets, ultra-low carbon steel sheets, high-strength carbon steel sheets, high carbon steel sheets, electrical steel sheets, or stainless steel sheets.

DESCRIPTION OF DRAWINGS

The above and other aspects, features and other advantages of the present invention will be more clearly understood from the following detailed description taken in conjunction with the accompanying drawings, in which:

FIG. 9 is a table showing various arrangements, both comparative and inventive, of the high-pressure water injection nozzle of the high-pressure supply unit and the abrasive input space through the second connecting portion.

DETAILED DESCRIPTION OF THE INVENTION

Hereinafter, the present invention will be described in detail with reference to the accompanying drawings.

FIGS. 2 to 5 illustrate a descaling device 1 according to the present invention and a use state thereof in the process thereof.

Figure 2:
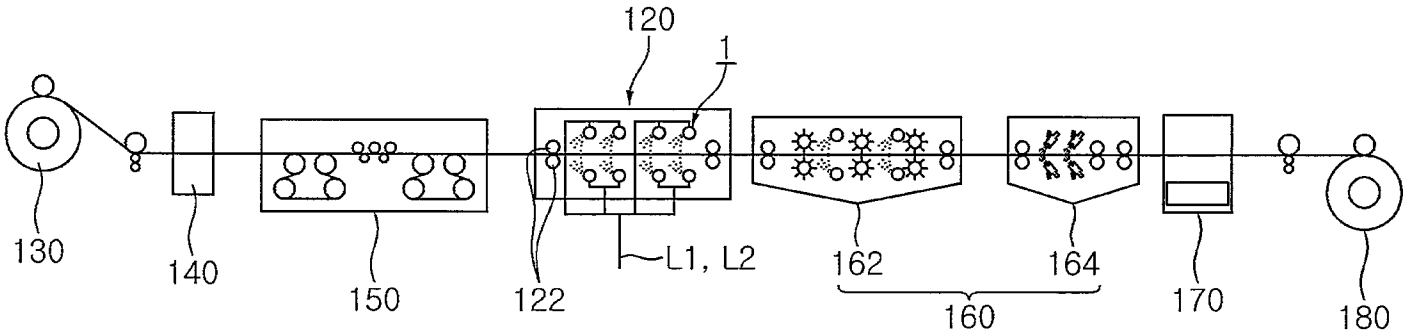
FIG. 2 is a schematic view illustrating a process of treating a surface of a hot-rolled steel sheet including a descaling device according to the present invention.

That is, as illustrated in FIG. 2, a hot-rolled coil primarily passes through a scale breaker 150 previously described while being unwound and wound at a high speed between a pay off reel 130 and a tension reel 180, and scale is removed while being passed through a chamber 120, in which the descaling devices 1 of the present invention are appropriately arranged at upper and lower sides of a moving steel strip 2 (hereinafter, referred to as "steel sheet"), by the medium of feed rolls 122.

Thereafter, the steel sheet passes through a washing tank 160 composed of a brushing tank 162 and a rinsing tank 164, and a drying tank (hot air tank) 170.

Figure 1:
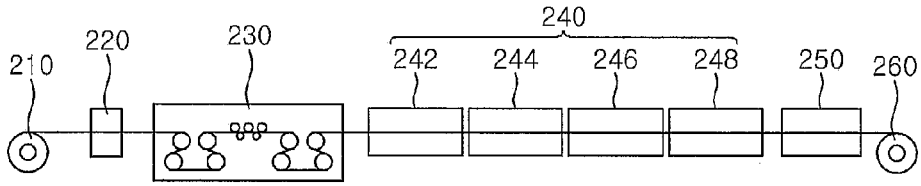
FIG. 1 PRIOR ART
FIG. 1 is a schematic view illustrating a typical process of removing scale through chemical pickling.

Therefore, when compared with FIG. 1, it may be understood that a facility size of a typical pickling tank 240 is significantly reduced in the case that the descaling device 1 of the present invention is used. Even in the simplified facility, the descaling device 1 of the present invention may provide sufficient descaling in a state in which the steel sheet 2 moves at a high speed, and in particular, may uniformize an average surface roughness Ra of the surface of the steel sheet (steel strip) after descaling in a range of 1 μm to 1.5 μm.

That is, since the descaling device 1 of the present invention may secure descaling efficiency and may also control the surface roughness of the steel sheet as well as the appropriate surface roughness thereof after descaling being provided, the descaling device 1 of the present invention may easily cope with processing characteristics required by customers or various conditions of the surface roughness required during subsequent processes, such as cold rolling and plating.

At this time, an undescribed reference numeral in FIG. 2, 140, denotes a welder for welding lead and tailing steel sheets unwound from the pay off reel 130 for continuous processing.

Figure 3:
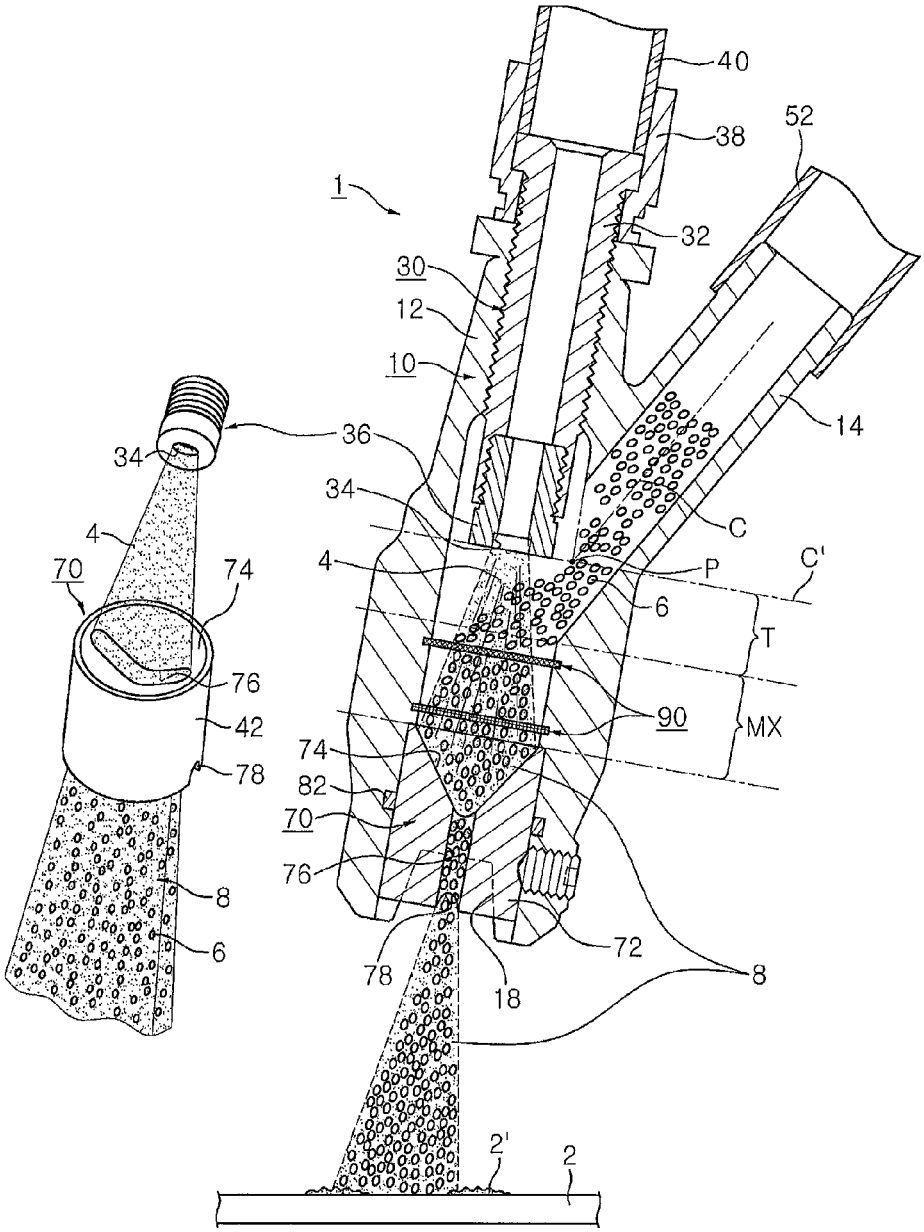
FIG. 3 is an entire schematic view illustrating the descaling device according to the present invention.
Figure 4:
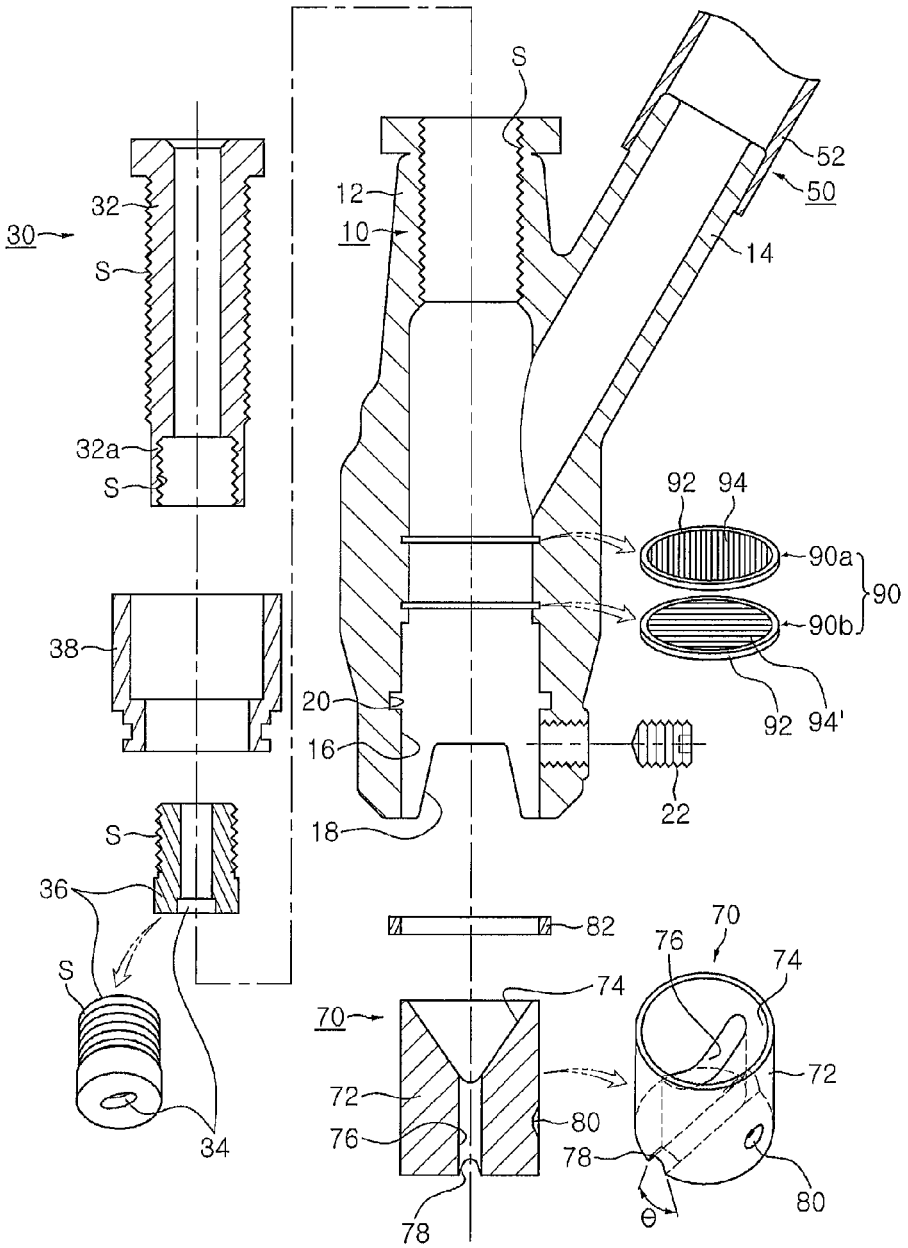
FIG. 4 is an exploded view illustrating the descaling device according to the present invention in FIG. 3.
Figure 5:
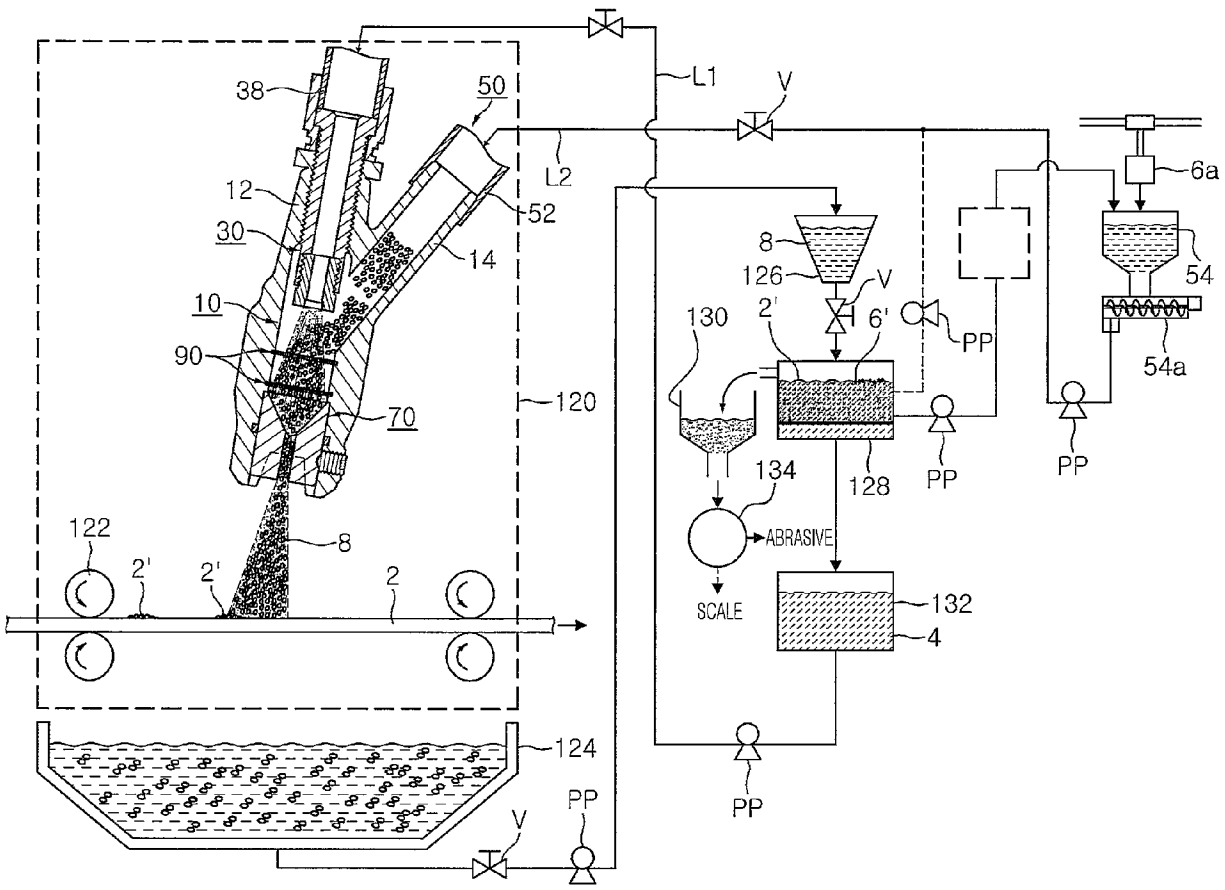
FIG. 5 is an entire schematic view illustrating surrounding facility linked to the descaling device according to the present invention.

FIGS. 3 to 5 illustrate the descaling device 1 of the present invention in more detail. In the drawing, a magnified view of an abrasive 6 is illustrated. Also, high-pressure water 4 is described as an example of a high-pressure fluid below.

That is, as illustrated in FIGS. 3 and 4, the descaling device 1 of the present invention may broadly include one or more device housings 10 disposed in a feed path of the moving hot-rolled steel sheet 2 (at a high speed) and a high-pressure water supply unit 30 included in the device housing 10 so as to supply the high-pressure water 4 to the device housing 10.

In particular, the device of the present invention does not simply provide the high-pressure water inside the single device housing 10, but employs a double injection method injecting the high-pressure water from the inside thereof. As described in detail below, the reason for the internal injection is that the abrasive may not only be smoothly introduced into the device housing by using injection pressure of the high-pressure water injected inside the device without the application of external pressure, but the abrasive, i.e. glass beads or ceramic beads, may also be smoothly mixed with the water (high-pressure water).

That is, the device of the present invention may further include an abrasive input unit 50 able to introduce the abrasive 6 into the device housing 10 through smooth suction by the medium of injection pressure of the high-pressure water 4 without the application of external pressure and an abrasive slurry spraying unit 70 included in the device housing to spray an abrasive slurry 8 having the high-pressure water 4 and the abrasive 6 mixed inside of the device housing on the steel sheet by using a direct spray method.

Therefore, in the present invention, when the high-pressure water 4 is injected from the inside of the device housing 10 into the device housing 10, a negative pressure space T may be formed inside the device housing as illustrated in FIG. 3, and, as a result, the abrasive 6 may be smoothly introduced through suction without the application of external pressure.

Next, the high-pressure water 4 and the abrasive 6 may be mixed inside the device housing 10 of the present invention to be sprayed into the surface of the steel sheet 2 moving in the chamber 120 through the abrasive slurry spraying unit 70 as illustrated in FIG. 5, and thus, an effect of removing scale (see 2' in FIGS. 3 and 5) on the surface of the steel sheet may be maximized.

Eventually, when the descaling device 1 of the present invention, as illustrated in FIGS. 3 and 5, simply introduces the abrasive 6 into the device housing 10 without the separate application of external pressure, the abrasive 6 may be relatively uniformly sucked into the device housing by the formation of the internal negative pressure space T due to the high-pressure water 4. Since external pressure facility may not be required, the structure of the device may be simplified.

At this time, with respect to the abrasive 6 of the present invention required for preparing the abrasive slurry 8 able to remove scale or other residual foreign objects by being in contact with the surface of the steel sheet while being mixed with the high-pressure water, an abrasive having a specific gravity lower than that of metal may be used. For example, silicon oxide, silicon carbide, aluminum oxide, glass, or ceramic may be used.

For example, glass or ceramic beads having a uniform diameter may be used as an abrasive, and the glass or ceramic beads in a powder form (since the diameter thereof is actually relatively small, the beads look like a powder) may only be introduced into the device housing or a slurry (solution state having viscosity) having the glass or ceramic beads mixed with water in advance may be provided.

Although magnified in FIGS. 3 and 5, a diameter of the abrasive 6 provided as the glass beads or ceramic beads may be in a range of 10 μm to 400 μm, and for example, may be in a range of 80 μm to 200 μm.

At this time, in the case that the diameter of the abrasive is 10 μm or less, the effect of removing the scale 2' from the surface of the steel sheet may be insignificant due to excessively small diameter thereof. In contrast, in the case in which the diameter of the abrasive is 400 μm or more, the efficiency of removing the scale may be improved, but a deviation in the surface roughness of the steel sheet 2 after descaling may be high. Therefore, surface quality of the steel sheet may not be secured and a subsequent process, such as a separate milling process, may be required.

Meanwhile, typical abrasives, such as metal shot balls, grit particles, or stainless steel beads, and glass beads of the present invention are compared and listed in the following Table 1.

TABLE 1

| Category | $Al_2O_3$ (Grit) Steel (Grit) SiC (Grit) | STS (bead) | Glass (bead) |
|---|---|---|---|
| Remarks | With respect to a slurry having typical grit particles mixed with water, a deviation in the surface roughness of steel sheet is high due to the occurrence of a phenomenon of embedding in a material and an average diameter thereof is in a range of 141 μm to 147 μm, and since a wet process is used, reprocessing may be difficult. | Since unit price of a typical stainless steel bead is expensive and a diameter thereof is small at about 60 μm, the efficiency of removing scale may be low. | A diameter of the glass bead of the present invention is about 117 μm, and since the efficiency of removing scale is appropriate, costs are low, reprocessing is facilitated, and in particular, the phenomenon of embedding in a material is absent, the deviation in the surface roughness may be low. |

Therefore, as illustrated in Table 1, the abrasive of the present invention may be selected from glass or ceramic having a specific gravity lower than that of metal, which may also control the average surface roughness of the steel sheet as well as the appropriate average surface roughness thereof after descaling being provided, but the glass or ceramic may be allowed to have a bead shape. That is, the present invention may remove limitations generated during the use of typical shot balls, grit particles, and stainless steel beads.

Next, an appropriate injection pressure of the high-pressure water 4 of the present invention may be in a range of 100 bar to 500 bar based on the abrasive 6, the foregoing glass beads having a diameter ranging from 10 μm to 400 μm, in order to appropriately form negative pressure (space) to smoothly suck the abrasive 6, such as glass beads, into the device housing 10 and also stably maintain the removal of scale from the surface of the steel sheet.

At this time, in the case that the pressure of the high-pressure water is 100 bar or less, spray pressure of the abrasive slurry finally sprayed from the device may be low, and thus, the efficiency of removing scale from the surface of the steel sheet may be insignificant. In contrast, in the case that the pressure thereof is 500 bar or more, since the collision pressure of the abrasive on the surface of the steel sheet may be excessively high, the deviation of the surface roughness Ra of the steel sheet may be relatively high, and equipment operating costs, such as electricity costs due to the overloading of equipment during the operating thereof, may increase.

Next, the descaling device 1 of the present invention satisfying the foregoing conditions of the pressure of high-pressure water and the abrasive will be described in detail. First, as illustrated in FIGS. 3 and 4, the device housing 10 in the device of the present invention may include a first connecting portion 12 connected to the high-pressure water supply unit 30 to be later described in detail, a second connecting portion 14 connected to the abrasive input unit 50, and a spraying unit assembly portion 16 having the abrasive slurry spraying unit 70 assembled therein.

The device housing 10 of the present invention, for example, may be divided and assembled for internal assembly by being manufactured in a cast form, and the first connecting portion 12 at an upper side thereof and the second connecting portion 14 in an inclined state at a center portion thereof are formed in a single piece.

Also, an opening 18 having a chamfered shape is formed in a lower end portion of the device housing 10 of the present invention, in order to allow the abrasive slurry 8 to be spread during spraying.

Although not specifically illustrated in a separate drawing, a plurality of the device housings 10 of the present invention may be actually arranged in an appropriate spacing in an equipment head unit (not shown). In particular, a hydraulic cylinder may be connected to the head unit to adjust a spacing between the steel sheet and a lower end of the device housing and, as shown in FIG. 3, the tilt of the device housing 10 may also be adjusted through driving gears or the like to be obliquely arranged toward the moving steel sheet within 45 degrees.

For example, as illustrated in FIGS. 3 and 5, the head unit connected to the device housing 10 of the unit descaling device of the present invention is required to adjust a spray width of the abrasive slurry according to the width of the moving hot-rolled steel sheet 2 and in particular, the abrasive slurry 8 sprayed on the steel sheet may also be sprayed on upper and lower portions of the hot-rolled steel sheet 2 in the same spray pattern.

In particular, both end portions (interface portion) of an abrasive slurry stream sprayed from the unit device may be controlled to have an overlapping pattern.

Also, the spray pressure or spray angle of the abrasive slurry and the spacing between the lower end of the device and the steel sheet may be adjusted in consideration of a thickness of scale generated according to a moving speed of the steel sheet or a thickness of the steel sheet.

For example, as illustrated in FIGS. 3 and 5, spacing between an outlet of the spraying unit 70 at the lower end of the device hosing 10 of the present invention and the steel sheet 2 may be adjusted in a range of 100 mm to 350 mm. The spacing between the outlet of the spraying unit and the steel sheet may directly affect descaling performance or a descaling width, and, for example, in the case that the spacing is 100 mm or less, the descaling width may be relatively narrow, and thus, the number of the device housing installed may be unnecessarily increased. In contrast, in the case in which the spacing is 350 mm or more, the descaling performance may be insignificant.

Also, the second connecting portion 14 connected to the abrasive input unit 50 of the device housing 10 may also be obliquely formed toward the device housing 10. For example, the second connecting portion 14 may be inclined at an angle of about 45 degrees, when considering the fact that the abrasive 6 is fine beads having a diameter in microns and injected into the device housing without the application of external pressure.

Next, as illustrated in FIGS. 3 and 5, the high-pressure water supply unit 30 of the descaling device 1 of the present invention is provided inside the device housing while being provided in the first connecting portion 12 of the device housing 10, and may include a high-pressure water supply inlet 32 connected to a high-pressure water supply tube 40 and a high-pressure water nozzle 36 provided in the high-pressure water supply inlet 32 and having a nozzle hole 34 formed therein.

That is, as illustrated in FIGS. 3 and 4, the high-pressure water supply inlet 32 passes through a locking cap 38 provided in an upper portion of the first connecting portion 12 of the device housing 10 to be supported by stopping at a stopper protrusion at an upper end thereof, and a screw portion S formed on an outer circumference of the high-pressure supply inlet 32 are assembled by being fastened to a screw portion S formed on an inner circumference of the first connecting portion 12 of the device housing 10.

A high-pressure supply hose 40 is connected to the locking cap 38 to supply the high-pressure water 4 thereto and the supplied high-pressure water is provided through an internal hole of the supply inlet 32.

At the same time, as illustrated in FIG. 4, a screw portion S formed on an outer circumference of an upper portion of the high-pressure water nozzle 36 may be simply provided in a screw portion S formed on an inner circumference of a spray nozzle assembly portion 32*a* at a lower end of the high-pressure water supply inlet 32.

Therefore, the supplied high-pressure water is injected into the device housing 10 through the nozzle hole 34 formed through the center of the high-pressure water nozzle 36.

At this time, as illustrated in FIGS. 3 and 4, the nozzle hole 34 formed in the high-pressure water nozzle 36 may be formed in an elliptical shape so as to allow the high-pressure water to be injected in a spreading form into the device housing 10.

In particular, as illustrated in FIG. 3, the high-pressure water 4 injected in a spreading form may be injected in a thin and wide shape corresponding to a slit-form spray opening 76 formed in a body 72 of the abrasive slurry spraying unit 70 to be later described in detail.

That is, in the device of the present invention, the nozzle hole 34 included in the high-pressure water nozzle 36, for example, may be formed in an elliptical shape elongated in a direction corresponding to the slit-form spray opening 76 of the abrasive slurry spraying unit 70.

Next, as illustrated in FIGS. 3 to 5, the abrasive input unit 50 in the descaling device 1 of the present invention includes an abrasive input hose 52 connected to the second connecting portion 14 obliquely formed in the center portion of the device housing 10.

A thick hose is used for the abrasive input hose 52 so as to maintain stiffness and an abrasive, i.e., the glass or ceramic bead abrasive 6, may be supplied through a line L2 by being linked to an abrasive supply hopper 54 to later be described in FIG. 5.

Therefore, in the device of the present invention as illustrated in FIG. 3, since the high-pressure water nozzle 36 of the high-pressure supply unit 30 injects the high-pressure water at an appropriate pressure while being provided in the lower portion of the high-pressure water supply inlet 32 elongated and entered into the device housing 10 and the device housing 10 is closed, the negative pressure space T having pressure rapidly decreased may be formed in a lower portion of the high-pressure water injection nozzle 36.

Eventually, at the moment of introducing the abrasive to the device housing through an inner outlet (see C" in FIG. 6) of the second connecting portion 14 of the device housing connected to the abrasive supply hose 52 disposed near the high-pressure water injection nozzle 36, the abrasive is smoothly introduced to the negative pressure space without the application of external pressure, and the high-pressure water 4 and the abrasive 6 are mixed to form the abrasive slurry 8 finally sprayed on the surface of the steel sheet.

That is, since the present invention provides a configuration in which the abrasive is sucked into the device housing through the formation of negative pressure in the device housing without using a separate external pressure apparatus, an overall structure of the device may be simplified, and, as a result, cost reduction through the simplification of the structure of the device may be possible and in particular, an increase in operation costs of the device according to the application of external pressure may be prevented.

Figure 6:
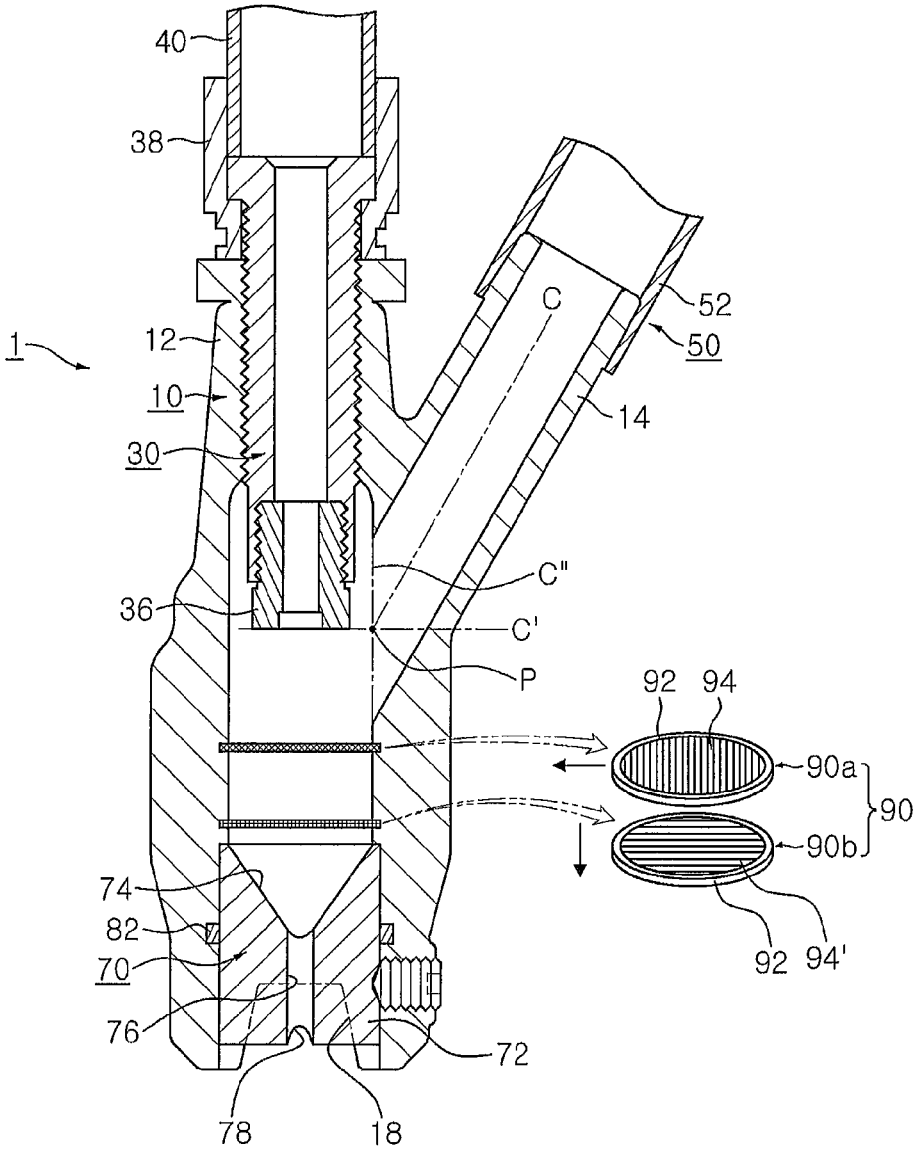
FIGS. 6 through 8 are schematic views illustrating various embodiments of a mixing device included in the descaling device according to the present invention.

Meanwhile, as illustrated in FIGS. 3 and 6, a horizontal line C' at a lower end of the high-pressure water nozzle 36 of the high-pressure water supply unit 30 in the device according to the present invention may be allowed to meet with an inner center P (center of an inner center line C of the second connecting portion in FIG. 6) of the second connecting portion 14 of the device housing 10 for the input of the abrasive.

In this case, the mixing of the injected high-pressure water 4 and the inputted abrasive 6 may be uniformly realized.

For example, appropriate arrangements of the high-pressure water injection nozzle of the high-pressure supply unit and the abrasive input space through the second connecting portion are presented in FIG. 9.

Therefore, as illustrated in FIG. 9, it may be understood that the position of the horizontal line at the lower end of the injection nozzle of the high-pressure water supply unit 30, for example, may be controlled to be at the center of the inner center line of the second connecting portion 14 and an outlet of the connecting portion in view of the descaling efficiency.

Meanwhile, as illustrated in FIG. 3, a mixing space MX having the high-pressure water 4 injected into a lower side of the negative pressure space T and the inputted abrasive 6, such as glass beads, mixed therein may be further formed in the device housing of the descaling device 1 of the present invention Mixing units described in detail in the following FIGS. 6 to 8 may be disposed in the mixing space MX of the present invention.

For example, mixability of the high-pressure water and the abrasive in the device of the present invention is important, and the reason for this is that only when the high-pressure water and the abrasive are uniformly mixed, the abrasive slurry 8 having the high-pressure water and the abrasive uniformly mixed therein is sprayed on the surface of the steel sheet and accordingly, the descaling efficiency may not only increase, but the deviation of the average surface roughness of the steel sheet after descaling may also be small. The mixing units will be described in detail in the following FIGS. 6 to 8.

Next, FIGS. 3 to 5 illustrate the abrasive slurry spraying unit 70 able to actually remove scale while the abrasive slurry 8 is appropriately sprayed from the descaling device 1 and accordingly, the average surface roughness of the steel sheet is controlled to be in an appropriate range.

That is, the abrasive slurry spraying unit 70 of the present invention may include the spraying unit body 72, a cylindrical body formed in a lower end portion of the device housing 10 in a lower side of the negative pressure space T in the device housing and provided in the spraying unit assembly portion 16 including a concavely formed cut portion 18, depressed portion 74 allowing the abrasive slurry to be sprayed in a more uniform state by inducing laminar flow of the abrasive slurry 8 in an upper side of the spraying unit body, and an abrasive slurry spray opening 76 provided to allow the abrasive slurry to be sprayed on the steel sheet by vertically penetrating through the spraying unit body from the depressed portion.

At this time, as illustrated in FIGS. 3 and 4, the depressed portion 74 may be formed as a conical depression portion concavely recessed into an upper portion of the spraying unit body 72.

Also, as illustrated in FIG. 4, a fixing ring 82 inserted and provided in a fixing groove 20 formed in a side of the spraying unit assembly portion 16 of the device housing 10 is provided in an outer circumference of the cylindrical body 72 of the spraying unit, and a fixing hole 80 having a lock pin 22 fastened in the form of a screw from the outside of the device housing fixed therethrough is formed on the outer circumference thereof.

Therefore, in the device according to the present invention, the cylindrical body 72 of the abrasive slurry spraying unit 70 may be firmly assembled and fixed into the spraying unit assembly portion 16 of the device housing.

At the same time, in the abrasive slurry spraying unit 70 of the present invention, the abrasive slurry spray opening 76 may be provided in the form of a slit integrally penetrating from a center portion of the conical depression portion 74 to a lower end of the body.

Therefore, as illustrated in FIGS. 3 to 5, since the high-pressure water 4 injected from the inside of the device housing forms the negative pressure space T to generate suction of the abrasive without the application of external pressure, and the abrasive 6 formed of glass beads introduced at this time is uniformly mixed in the mixing space MX at the lower side of the high-pressure water nozzle 36 of the high-pressure water supply unit, and is then induced in the form of laminar flow toward the center of the conical depression portion 74 concavely formed in the upper portion of the body of the spraying unit 70 and sprayed through the slit-form spray opening 76 at the center thereof, the abrasive slurry 8 finally sprayed on the surface of the steel sheet may be more uniformly sprayed in comparison to the case of simply including a nozzle opening in FIG. 9.

In particular, since an abrasive slurry stream sprayed through the concave conical depression portion 74 of the spraying unit 70 and the slit-form spray opening 76, as illustrated in FIG. 3, is sprayed in the shape having predetermined thickness and width, scale from the surface of the steel sheet may be further intensively removed.

Therefore, an inlet of the spray opening 76 is provided in a "V" shape due to the conical depression portion 74 and an outlet thereof, although not illustrated using a separate reference numeral, is provided as a rectangular flat opening.

At this time, as illustrated in FIGS. 3 and 4, the cut portion 78 having a predetermined angle (θ in FIG. 4) through the spray opening may be further formed at both sides of the spraying unit body on both sides of the lower end portion of the slit-form spray opening 76 formed by penetrating through the center of the body 72 of the spraying unit 70.

Therefore, the cut portion 78 may allow the sprayed abrasive slurry stream to be appropriately spread in the lower end portion of the spraying unit and thus, may more uniformly and smoothly remove scale on the steel sheet.

At this time, the cut portion 78 connected through the outlet of the spray opening 76 at both sides of the lower end portion of the body of the spraying unit may be formed to have an angle ranging from 15 degrees to 30 degrees, and in this case, a contact area of the surface of the steel sheet by the appropriately sprayed abrasive slurry 8 may be appropriately increased.

Eventually, since the abrasive slurry spraying unit 70 of the present invention allows the high-pressure water 4 and the abrasive 6 in a mixed state to be induced toward the center of the concave depressed portion 74 and to be sprayed through the slit-form spray opening 76, the descaling efficiency may be high, and thus, uniform mixing between the water and the abrasive may be obtained as well as sufficient descaling performance being secured even in the case that a line speed of the steel sheet is increased. Therefore, the average surface roughness of the steel sheet after descaling may be maintained in a range of 1 μm to 1.5 μm through the uniform distribution of the abrasive actually being in contact with the surface of the steel sheet during descaling.

That is, since the deviation of the surface roughness is low, scale may be uniformly removed from the entire surface of the steel sheet, and thus, surface quality of the steel sheet may be excellently maintained.

Next, as described above, FIGS. 6 to 8 illustrate various types of the mixing units for the high-pressure water and the abrasive installed in the mixing space MX of the present invention in FIG. 3 to allow the water and the abrasive to be smoothly mixed therein.

Figure 7:
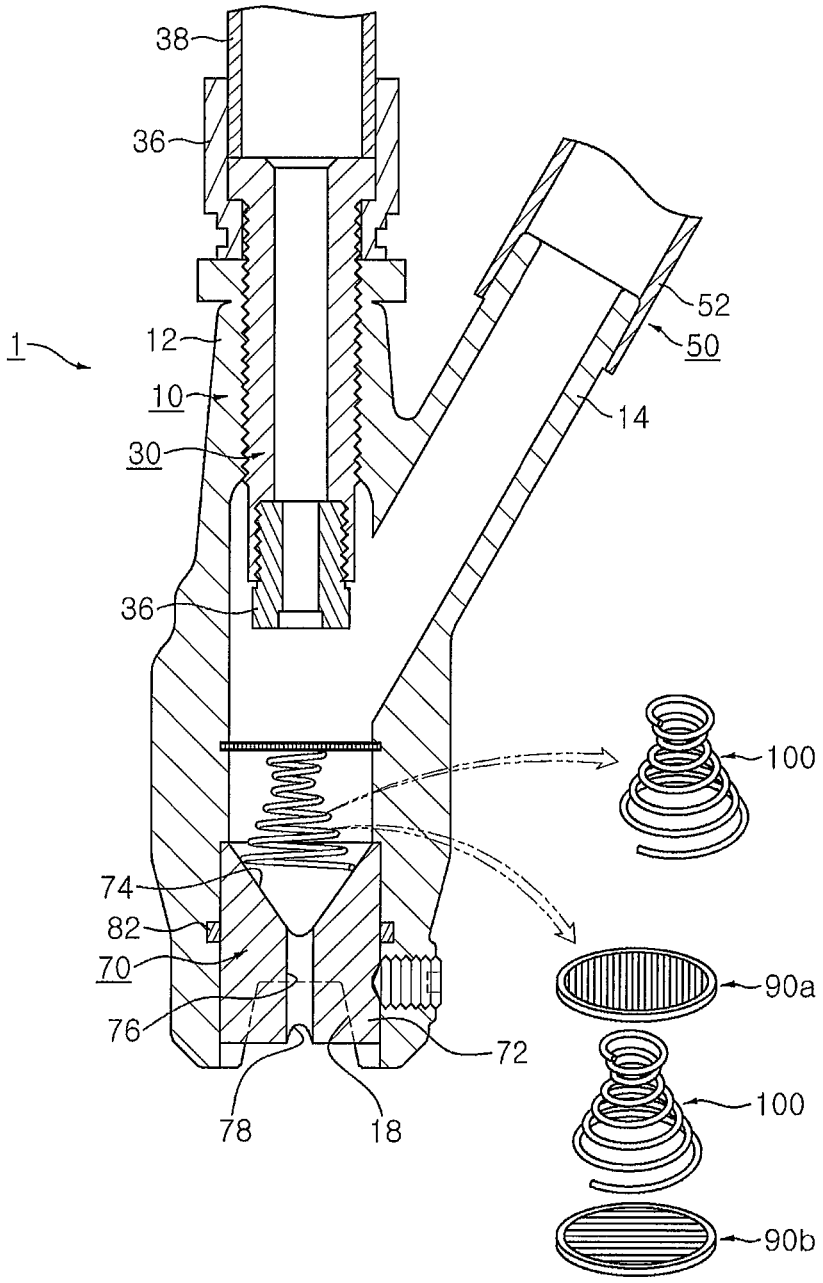
Figure 8:
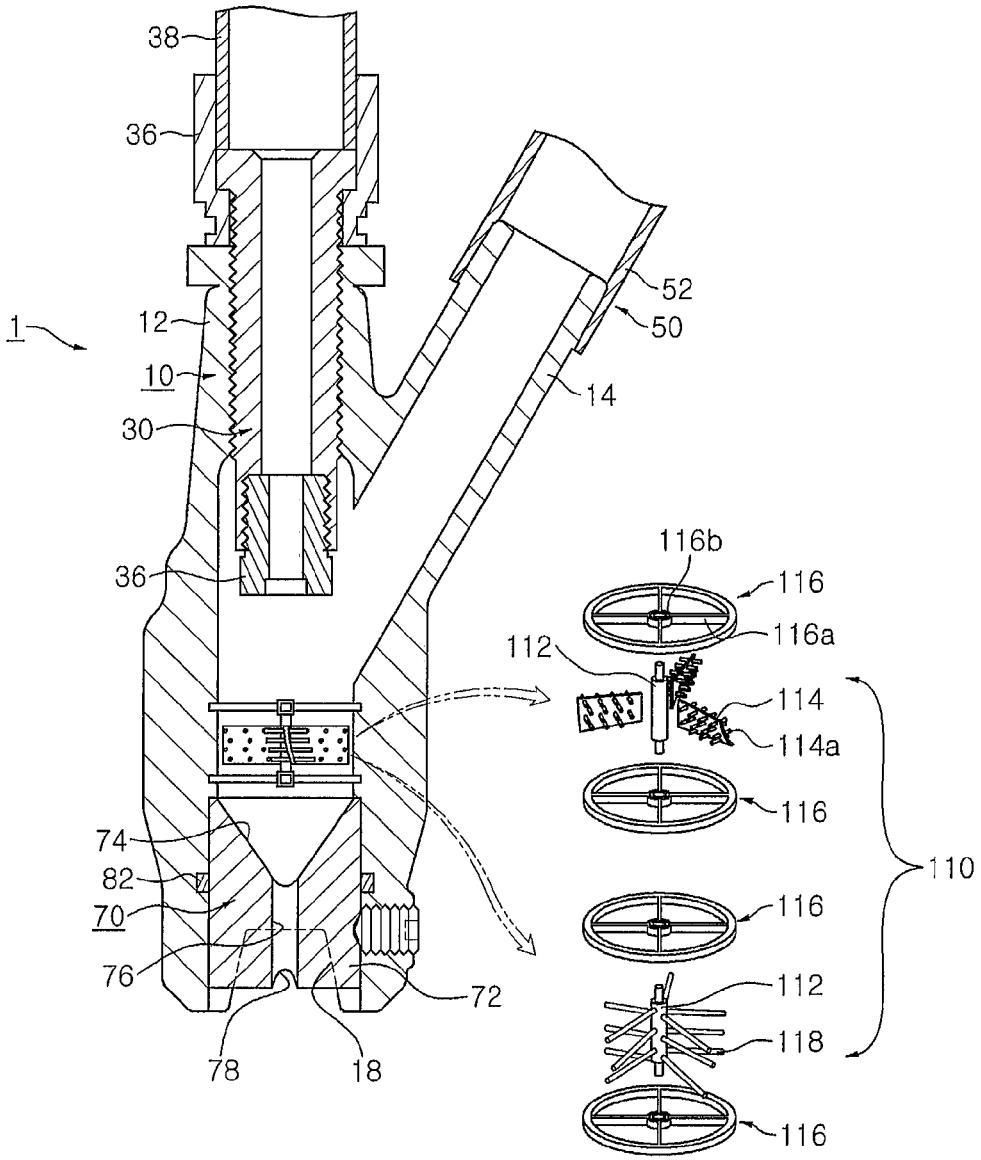

That is, as illustrated in FIGS. 6 to 8, the mixing units of the present invention may be specifically classified as a position fixed-type mixing unit and a rotary type mixing unit 110.

For example, the position fixed-type mixing units are illustrated in FIGS. 6 and 7, and may be provided as one or more grid units 90 installed in the mixing space MX at a center side of the lower portion of the negative pressure space T of the device housing 10 in a lower side of the high-pressure water supply unit 30 in the device housing 10 as illustrated in FIG. 6 or a conical coil 100 provided between the grid units or independently provided as illustrated in FIG. 7.

At this time, as illustrated in FIGS. 3 and 6, the grid units 90 of the present invention, for example, may be provided as upper and lower sides, first and second grid units 90*a* and 90*b*.

That is, as illustrated in FIGS. 4 and 6, the grid units 90 has a configuration in which abrasive slurry collision bars 94 and 94' arranged in a mutually perpendicular direction according to the positions of upper and lower portions are fixed into the inside of fixing rings 92 provided in fixing grooves (no reference numeral) formed in an inner side of the lower end portion of the device housing 10.

Therefore, mixing of the high-pressure water (water) and the abrasive may be smoothly performed while the abrasive slurry 8 having the high-pressure water and the abrasive mixed therein passes through the upper and lower sides, first and second grid units, i.e., the collision bars 94 and 94' having an opposite direction, from top to bottom.

For example, since the collision bars of the first and second grid units are orthogonally arranged, mixing of the water and the abrasive may be more smoothly performed while the collision bars rotate in a different direction from each other, in the case that the abrasive slurry 8 collides with the actual bars.

Next, as illustrated in FIG. 7, other types of the position fix mixing units may be provided as a conical coil (coil spring) 100 disposed in the mixing space MX inside the device housing illustrated in FIG. 3.

Since an upper end or a lower end of the conical coil 100, a position fixed-type mixing unit, has a small diameter and the coil diameter increases toward an opposite side thereof, mixing of the high-pressure water and the abrasive may be more uniformly performed when the abrasive slurry 8 having the high-pressure water and the abrasive mixed therein passes through the conical coil.

Meanwhile, the conical coil 100, a position fixed-type mixing unit, is disposed between the first and second grid units 90*a* and 90*b* previously described or disposed in a lower portion of the upper side first grid unit, and is possible to have a configuration in which a lower end portion of the conical coil is stably placed on the conical depression portion 74 formed in an upper portion of the cylindrical body 72 of the abrasive slurry spraying unit 70.

In any case, mixing of the high-pressure water (water) and the abrasive may be uniformly performed while the abrasive slurry passing through the conical coil by the pressure of the sprayed high-pressure water stepwisely collides from space having a small diameter to space having a large diameter.

Next, the rotary mixing unit 110 in the present invention device is illustrated in FIG. 8. The mixing units in FIGS. 6 and 7 are provided in a state of fixing a position, such as a grid or conical coil, but the rotary type mixing unit 110 of the present invention has the characteristics in that mixability of the high-pressure water and the abrasive may be further improved while the abrasive slurry collides to idle as passing through the mixing units.

For example, as illustrated in a magnified portion in FIG. 8, other types of the rotary type mixing units of the present invention may be provided as one or more rotors 114 connected to a rotational axis 112 disposed in the lower side of the negative pressure space T in the device housing or collision bars 118 having an inclined shape connected to the rotational axis 112.

At this time, as illustrated in FIG. 8, the rotational axis 112 may be provided in a bearing 116*b* fixed at the center of connecting bars 116*a* connected to a fixing ring 116 provided inside the device housing.

Therefore, the rotational axis 112 rotates by the medium of the bearing, and in particular, the rotors 114 included in the rotational axis are inclined in the shape having twisted upper and lower portions, and abrasive collision bars 114*a* may be further included in the rotors 114.

Eventually, when the high-pressure water is injected inside the device housing at a high pressure, the rotors forcibly rotate by the medium of the rotational axis as the high-pressure water vertically injected collides therewith and thus, mixing of the high-pressure water and the abrasive may be more effectively performed.

Meanwhile, as illustrated in FIG. 8, in the case that abrasive collision bars 118 inclined in a vertical direction along the rotational axis 112 are installed instead of the rotors, water and abrasive may be sufficiently mixed as they collide with the collision bars.

At this time, in the case that the collision bars 118 are obliquely installed in the rotational axis, the rotational axis 112 may rotate between bearings due to the collision pressure of the high-pressure water passing therethrough.

Eventually, the rotors 114 or the collision bars 118 included in the rotational axis 112 of the rotary type mixing units 110 of the present invention allow the water and the abrasive to be mixed as uniformly as possible, and then allow them to be sprayed on the surface of the steel sheet through the spraying unit 70.

That is, the mixing units 90, 100, and 110 of the present invention uniformize a mixed state of the water and the abrasive in the abrasive slurry sprayed from the device to be able to effectively and uniformly remove scale on the entire surface of the steel sheet when the abrasive slurry collides with the surface of the steel sheet, and in particular, to reduce the deviation of the average surface roughness of the steel sheet after descaling. Therefore, the foregoing appropriate surface roughness may be maintained and as a result, quality may be improved by smoothly performing a post-treatment process of the surface of the steel sheet.

Next, FIG. 5 illustrates the descaling device 1 of the present invention described above and supplementary facilities able to substantially supply the high-pressure water and the abrasive to the device and process removed scale 2' and damaged glass bead abrasive 6' after spraying, and in particular, to recycle the abrasive.

First, as illustrated in FIGS. 2 and 5, the appropriate numbers of the descaling devices 1 of the present invention are disposed above and under the steel sheet, the chamber 120 surrounding the device and the moving steel sheet in order to prevent scatter of the sprayed abrasive slurry 8 is disposed in a region having the descaling device 1 of the present invention installed therein, and the steel sheet feed rolls 122 for moving the steel sheet may be disposed at an inner side of the chamber.

Although schematically illustrated in the drawings, a collection hopper 124 for collecting the water 4 and the abrasive 6 in the sprayed abrasive slurry 8 is installed in a lower side of the chamber 120, and the sprayed abrasive slurry 8 is collected in a cyclone 126 through a pump pp and a valve V and then introduced into a separation tank 128 installed under the cyclone 126 for separating the collected scale 2' and the damaged abrasive 6'.

Therefore, the water is collected in a water supply tank 132 disposed below through an inner screen (no reference numeral) of the separation tank 128 and the abrasive 6 is provided to an abrasive supply hopper 54 connected to the line L2 and the input hose 52 of the abrasive input unit 50 connected to the second connecting portion of the device housing.

At this time, as illustrated in FIG. 5, new abrasives 6*a* may be periodically supplied to the supply hopper 54 through a feeding unit and a screw 54*a* for discharging is installed in a lower side of the supply hopper 54.

Meanwhile, water in the water collection tank 132 may be provided to the supply hose 40 of the high-pressure water supply unit 30 through a pumping device PP and a line L1.

At this time, overflow may be generated in the separation tank 128 to allow the removed scale 2' and the fractured abrasive 6' floated on the water to be introduced into a treatment tank 130, and the scale 2' and the fractured glass bead abrasive 6' passing through the treatment tank may be finally treated by being respectively separated through a magnetic separator 134.

Eventually, as illustrated in FIG. 5, the descaling device 1 of the present invention is linked to the supplementary facilities to collect the removed scale 2' and the abrasive 6, and as a result, recycling of the abrasive may be possible.

Meanwhile, the abrasive collected in the abrasive separation tank in FIG. 5 may be provided to the abrasive supply hopper 54 in a dried state by passing through a dryer (no reference numeral-marked in dotted line).

Also, the collected water and the abrasive in FIG. 5 are provided to the line L2 through a pumping device to be able to be supplied as a slurry form having the water and the abrasive mixed therein to the hose 52 of the abrasive input unit 50.

Next, a descaling operation through the foregoing descaling device of the present invention will be summarized below.

First, as illustrated in FIGS. 3 to 5, in the descaling process of the resent invention, the abrasive 6 having a specific gravity lower than that of metal is introduced into the device by the medium of the negative pressure space T formed through the high-pressure water 4 injected inside the descaling device 1 without the application of external pressure.

Next, the abrasive slurry 8 having the high-pressure water 4 and the abrasive 6 mixed in the mixing space MX is sprayed on the surface of the steel sheet to remove scale or other residual foreign objects on the surface of the steel sheet.

At this time, as described above, the pressure of the high-pressure water may be controlled to be in a range of 100 bar to 500 bar, and the abrasive having a specific gravity lower than that of metal may be provided as glass beads (fine balls) or ceramic beads having a diameter ranging from 10 μm to 400 μm so as to maintain the average surface roughness of the steel sheet after descaling in a range of 1 μm to 1.5 μm.

Meanwhile, examples through the foregoing descaling device of the present invention will be described below.

Example 1

A scale treatment was performed on a hot-rolled low carbon steel sheet (2.0 mm thickness×1200 mm width) at a line speed of 50 mpm based on the process described in FIG. 2 while the steel sheet was continuously passed under the conditions of the following Table 3. As a result, a level of residual scale was less than 1%, similar to that of a typical hot-rolled steel sheet treated by pickling, an average surface roughness of the steel sheet was 1.2 μm, and glossiness of the surface thereof was also excellent.

TABLE 3

| Category | Treatment condition |
|---|---|
| Scale breaker | Elongation 1.2%, Amount of bending 20 mm, Surface temperature of steel sheet 50° C. |
| High-pressure spray of abrasive slurry | Abrasive (glass beads, 150-200 μm), spray pressure 200 bar |
| Spray condition | Spray angle 15 degrees, Spacing between the device and the steel sheet 230 mm |

Example 2

A scale treatment was performed on a hot-rolled high-strength steel sheet (4.0 mm thickness×1200 mm width) containing 0.1% of carbon, 1.2% of silicon, and 1.2% of manganese at a line speed of 50 mpm based on the process described in FIG. 2 and under the conditions of the following Table 4. As a result, a level of residual scale was less than 2%, similar to that of a typical hot-rolled steel sheet treated by pickling, an average surface roughness of the steel sheet was 1.5 μm, and glossiness of the surface thereof was excellent and surface defects due to red scale were decreased.

TABLE 4

| Category | Treatment condition |
|---|---|
| Scale breaker | Elongation 1.2%, Amount of bending 30 mm, Surface temperature of steel sheet 10° C. |
| High-pressure spray of abrasive slurry | Abrasive (alumina, 100 μm), spray pressure 150 bar |
| Spray condition | Spray angle 30 degrees, Spacing between the device and the steel sheet 280 mm |

Example 3

A scale treatment was performed on a hot-rolled low carbon steel sheet (2.3 mm thickness×1000 mm width) at a line speed of 50 mpm based on the process described in FIG. 2 while the steel sheet was continuously passed under the conditions of the following Table 5. As a result, a level of residual scale was less than 1%, similar to that of a typical hot-rolled steel sheet treated by pickling, an average surface roughness of the steel sheet was 1.5 μm, and glossiness of the surface thereof was excellent.

TABLE 5

| Category | Treatment condition |
|---|---|
| Scale breaker | Elongation 2.5%, Amount of bending 30 mm, Surface temperature of steel sheet 50° C. |
| High-pressure spray of abrasive slurry | Abrasive (glass beads, 80 μm), spray pressure 300 bar |
| Spray condition | Spray angle 23 degrees, Spacing between the device and the steel sheet 150 mm |

Example 4

A scale treatment was performed on a hot-rolled low carbon steel sheet (2.3 mm thickness×1000 mm width) at a line speed of 50 mpm based on the process described in FIG. 2 while the steel sheet was continuously passed under the conditions of the following Table 6. As a result, a level of residual scale was less than 1%, similar to that of a typical hot-rolled steel sheet treated by pickling, an average surface roughness of the steel sheet was 1.5 μm, and glossiness of the surface thereof was excellent.

TABLE 6

| Category | Treatment condition |
|---|---|
| Scale breaker | Elongation 2.5%, Amount of bending 30 mm, Surface temperature of steel sheet 50° C. |
| High-pressure spray of abrasive slurry | Abrasive (glass beads, 100 μm), spray pressure 300 bar |
| Spray condition | Spray angle 15 degrees, Spacing between the device and the steel sheet 300 mm |

According to the present invention, descaling by means of a physical (mechanical) method excluding a typical chemical treatment may be realized and simplification of device structure and descaling process may be possible. Also, average surface roughness of a steel strip after descaling may be appropriately maintained and the control thereof may be possible, and thus, a highly efficient descaling and an environmentally-friendly device may be eventually provided.

While the present invention has been shown and described in connection with the exemplary embodiments, it will be apparent to those skilled in the art that modifications and variations can be made without departing from the spirit and scope of the invention as defined by the appended claims.

The invention claimed is:

1. A descaling device comprising:

a device housing disposed in a feed path of a hot-rolled steel strip;

a high-pressure fluid supply unit provided to supply a high-pressure fluid to the device housing;

an abrasive input unit provided to introduce an abrasive into the device housing;

an abrasive slurry spraying unit provided in the device housing to spray an abrasive slurry having the high-pressure fluid and the abrasive mixed inside the device housing onto the steel strip; and a mixing unit provided in the device housing to allow the high-pressure fluid and the abrasive to be smoothly mixed therein, wherein the device housing comprises:

a first connecting portion connected to the high-pressure fluid supply unit;

a second connecting portion connected to the abrasive input unit; and a spraying unit assembly portion having the abrasive slurry spraying unit assembled therein, wherein the high-pressure fluid supply unit comprises:

a high-pressure fluid inlet provided inside the first connecting portion included in the device housing and having the high-pressure fluid supplied thereto; and a high-pressure fluid nozzle provided to the high-pressure fluid inlet and having a nozzle hole formed therein to inject the high-pressure fluid into the inside of the device housing, wherein a horizontal line at a lower end of the high-pressure fluid nozzle passes through a center point of an outlet of the inclined second connecting portion included in the device housing, and wherein the mixing unit is provided as a fixed-type mixing unit formed of one or more grid units and one or more conical coils provided between the high-pressure fluid supply unit and the abrasive slurry spraying unit.

2. The descaling device of claim 1, wherein the high-pressure fluid supply unit provided in the device housing provides the high-pressure fluid by injecting the high-pressure fluid inside the device housing, and is configured to smoothly introduce the abrasive into the inside of the device housing by using injection pressure of the high-pressure fluid.

3. The descaling device of claim 2, wherein the abrasive input unit comprises an abrasive input hose connected to the second connecting portion included in the device housing, and a negative pressure space allowing the abrasive to be introduced into the device housing through suction by the medium of injection pressure of the high-pressure fluid is formed inside the device housing.

4. The descaling device of claim 1, wherein the abrasive has a specific gravity lower than that of metal.

5. The descaling device of claim 4, wherein the abrasive is formed of one of silicon oxide, silicon carbide, aluminum oxide, glass, or a ceramic having a particle diameter ranging from 10 μm to 400 μm.

6. The descaling device of claim 1, wherein the high-pressure fluid is formed of high-pressure water injected through the high-pressure fluid nozzle in a pressure range of 100 bar to 500 bar, and a spacing between the abrasive slurry spraying unit included in the device housing and the steel strip is in a range of 100 mm to 350 mm.

7. The descaling device of claim 1, wherein the abrasive slurry spraying unit comprises:

a spraying unit body provided in the spraying unit assembly portion included in the device housing;

a depressed portion formed in an upper portion of the spraying unit body; and an abrasive slurry spray opening formed by penetrating through the body from the depressed portion.

8. The descaling device of claim 7, wherein the depressed portion in the spraying unit body is concavely formed to have a conical shape from an upper end of the spraying unit body to an inner side thereof, and the spray opening is formed as a slit formed by integrally penetrating from a center of the conical depression portion to a lower end of the body.

9. The descaling device of claim 8, wherein a cut portion having a predetermined angle through the spray opening is further formed at both sides of the lower end of the spraying unit body.

10. A descaling device comprising:

a device housing disposed in a feed path of a hot-rolled steel strip;

a high-pressure fluid supply unit provided to supply a high-pressure fluid to the device housing;

an abrasive input unit provided to introduce an abrasive into the device housing;

an abrasive slurry spraying unit provided in the device housing to spray an abrasive slurry having the high-pressure fluid and the abrasive mixed inside the device housing onto the steel strip; and a mixing unit provided in the device housing to allow the high-pressure fluid and the abrasive to be smoothly mixed therein, wherein the device housing comprises:

a first connecting portion connected to the high-pressure fluid supply unit;

a second connecting portion connected to the abrasive input unit; and a spraying unit assembly portion having the abrasive slurry spraying unit assembled therein, wherein the high-pressure fluid supply unit comprises:

a high-pressure fluid inlet provided inside the first connecting portion included in the device housing and having the high-pressure fluid supplied thereto; and a high-pressure fluid nozzle provided to the high-pressure fluid inlet and having a nozzle hole formed therein to inject the high-pressure fluid into the inside of the device housing, wherein a horizontal line parallel to and extending from a lower end of the high-pressure fluid nozzle and perpendicular to an outlet of the inclined second connecting portion included in the device housing passes through a center point of the outlet of the inclined second connecting portion, and wherein the mixing unit is provided as a fixed-type mixing unit formed of one or more grid units and one or more conical coils provided between the high-pressure fluid supply unit and the abrasive slurry spraying unit.

* * * * *